United States Patent [19]

Muench, Jr.

[11] 4,420,735

[45] Dec. 13, 1983

[54] LOW CURRENT CLEARING BACK UP FUSE

[75] Inventor: Frank J. Muench, Jr., Waukesha, Wis.

[73] Assignee: RTE Corporation, Waukesha, Wis.

[21] Appl. No.: 284,606

[22] Filed: Jul. 20, 1981

[51] Int. Cl.[3] ..... H01H 85/30

[52] U.S. Cl. ..... 337/244; 337/252

[58] Field of Search ..... 337/158, 159, 161, 244, 337/248, 252

[56] References Cited

U.S. PATENT DOCUMENTS

| | | | |
|---|---|---|---|
| 3,263,048 | 7/1966 | Hicks | 337/244 X |
| 4,001,749 | 1/1977 | Kozacka | 337/244 |
| 4,150,353 | 4/1979 | Huber et al. | 337/252 X |
| 4,153,893 | 5/1979 | Swanson | 337/248 X |

*Primary Examiner*—George Harris

*Attorney, Agent, or Firm*—Raymond E. Fritz, Jr.

[57] ABSTRACT

An energy-limited fuse having a number of fuse elements spirally wrapped about a spider formed from a number of insulating plates, the fuse elements being supported in a parallel spaced relation at a distance sufficient for each element to operate independently and a striker pin assembly independently mounted in said fuse after said spider assembly has been mounted in said fuse, said striker pin assembly including a vaporizable wire for holding the striker pin in said striker pin assembly until the fuse elements are vaporized.

8 Claims, 9 Drawing Figures

LOW CURRENT CLEARING BACK UP FUSE

BACKGROUND OF THE INVENTION

Energy-limiting fuses have been supplied for many years for clearing fault currents in the region from 300 or 400 amperes to 50,000 and more amperes in one second or less. These fuses have difficulty in clearing smaller fault currents. To enhance fuse performance in the low current area series elements specially designed for low current clearing have been utilized alone or in combination. These elements include M-spots, auxiliary arcing elements, series integral expulsion sections, explosive charges, specialized alloys, gas-evolving spiders, and the like. However, all of these elements require additional cost and increase the complexity of the fuse.

Fuse manufacturers have also supplied blown fuse indicators with the energy-limiting fuses. These indicators typically include a strain wire running in parallel with the main fuse elements. The strain wire is solidly connected by soldering, braising, crimping, or winding the strain wire around the lead of the indicator. This type of solid connection makes handling of the striker pin assembly more difficult since the striker pin assembly is mounted on the spider assembly prior to incorporation of the spider assembly into the fuse. The striker pin assembly is exposed to damage in handling, requiring additional protective noses or guides, requires placing the strain wire through constricted openings, and requires that the entire striker pin assembly be pushed through the length of the insulated housing of the fuse.

SUMMARY OF THE INVENTION

The energy-limiting fuse according to the present invention provides low current clearing without the addition of any auxiliary elements. In this regard the wires which make up the normal fuse element are arranged in a widely spaced relation relative to each other so that each wire acts independently of the other wires in the fuse element. A fuse designed to carry 63 amperes continuously may be composed of three elements. If a single element sized to carry 63 amperes is used the element could not interrupt less than 500 or 600 amperes. If two or three elements are used spaced closely together in groups, intragroup flash-overs occur so that the three elements function only slightly better than a single element. By using widely separate elements, the chance of flash-over is greatly reduced.

In effect each element functions as a single fuse in parallel with the others. Using the sample above, there are in effect three 21 ampere fuses in parallel. Each would be capable of interrupting down to 150 to 200 amperes. By commutating, dividing the current between each of the elements and switching the current back and forth, each element functions independently creating more arc points, spreading out the heat of the arc, creating more cathode anode drops and allowing the fuse as a whole to clear the relatively low and mid-range currents. The spacing and control of the placement of the wires ensures that there will be no wire-to-wire flash-over causing shorting of the current, increasing the duty and causing the failure to clear.

A blown fuse indicator is combined with the present energy-limiting fuse to accomplish the required function of clearing fault currents while holding the interrupting duty imposed on associated equipment to a point which the associated equipment can easily handle.

This is in comparison to the existing high current clearing short time melt backup fuse (which requires 300 to 600 or more amperes before they reliably clear.) These currents are in excess of the duty of many of the associated switches. The indicator is partially mounted in a recess in the spider allowing for a longer striker pin with a corresponding wider selection of spring forces and travel distances.

IN THE DRAWING

DESCRIPTION OF THE INVENTION

Figure 1:
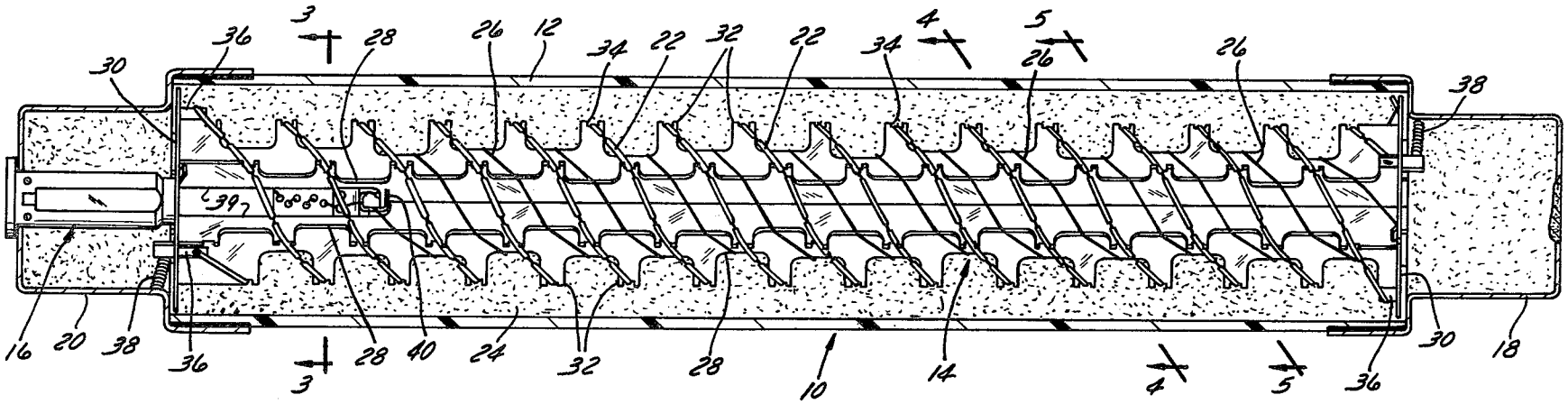
FIG. 1 is a section view of the fuse according to the present invention.
Figure 5:
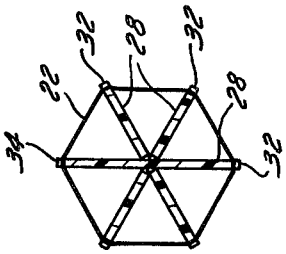
FIG. 5 is a view taken on line 5—5 of FIG. 1 showing the spider and one of the fuse wires.
Figure 4:
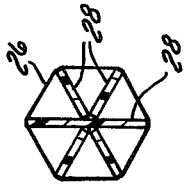
FIG. 4 is a view taken on line 4—4 of FIG. 1 showing the strain wire wound on the spider.
Figure 3:
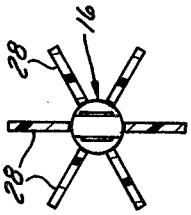
FIG. 3 is a view taken on line 3—3 of FIG. 1 showing a cross-section of the spider and striker pin assembly.
Figure 6:
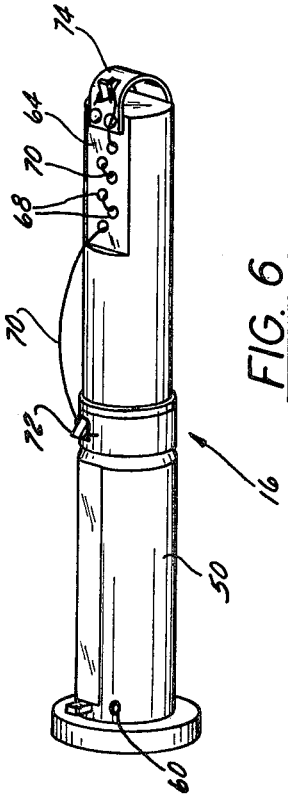
FIG. 6 is a perspective view of the striker pin assembly.

The energy-limiting fuse 10 as seen in FIG. 1 generally includes a tubular housing 12, a spider assembly 14 and a striker pin assembly 16. The tubular housing 12 is closed at each end by means of electrically conductive terminal caps 18 and 20. The electrical fuse circuit between the end caps 18 and 20 is completed by means of a number of fuse elements 22 provided on the spider assembly 14. The housing is filled with a granular dielectric material 24 such as silica sand. Each of the fuse elements 22 acts independently in response to fault currents to clear the circuit between the end caps 18 and 20.

The striker pin assembly 16 is an independent unit which is mounted within the fuse 10 after the fuse has been assembled. The striker pin assembly is activated by means of a strain wire 26 provided on the spider assembly. Whenever a fault condition occurs that fuses the elements 22, all of the fault current will pass through the strain wire 26 to actuate the striker pin assembly 16.

SPIDER ASSEMBLY

More particularly and referring to FIGS. 1 through 4, the spider assembly 14 generally includes three electrically insulating mica plates 28 held together at each end by means of conductive end plates 30. The mica plates can be of the type shown in U.S. Pat. No. 4,220,940 issued on Sept. 2, 1980 to William Huber for "Spider Assembly for a High Voltage Fuse." However, each mica plate 28 includes a plurality of tabs 32 along each edge. The tabs on each plate are offset from the tabs on the opposite edge of the plate and from the tabs on adjacent plates to form a spiral support for the fuse elements 22. The fuse elements 22 are held in a constrained spaced relation on the spider assembly by means of notches 34 provided at the outer end of each of the tabs 32. The space between the notches is four to five times the width of the fuse elements 22 to prevent flash-over between the elements during fault current condition.

Two or more fuse elements can be provided on the spider assembly in accordance with the rated capacity of the fuse. Each fuse element is individually or independently connected to a tab 36 provided on the plates 30. The spider assembly is positioned within the housing 12 with the end plates 30 connected to the caps 18 and 20 by means of a conductive lead 38.

Figure 2:
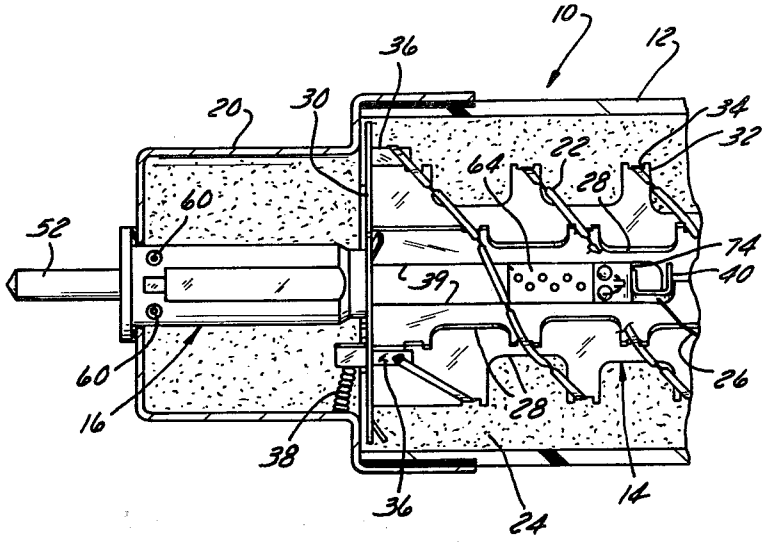
FIG. 2 is an enlarged view of a portion of FIG. 1 showing the striker pin assembly.
Figure 9:
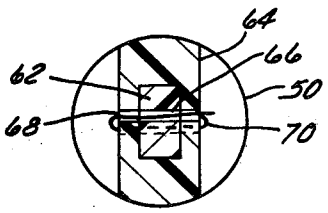
FIG. 9 is a view taken on line 9—9 of FIG. 7 showing the strain wire passing through the striker pin.
Figure 7:
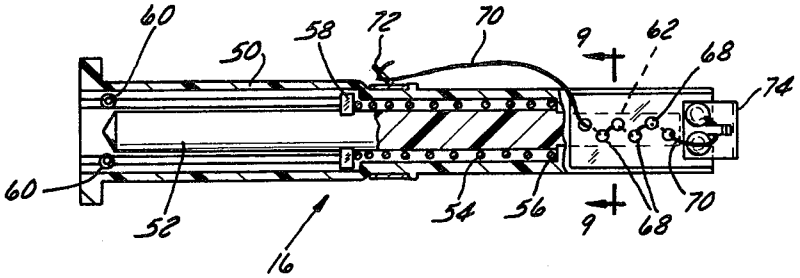
FIG. 7 is a cross-section view of the striker pin assembly shown in the retracted pin position.

Each of the mica plates 28 is provided with means at one end to accommodate the striker pin assembly 16. Such means is in the form of a notch or groove 39 at one end of each of the mica plates which define a recess for a portion of the spider assembly. The striker pin assembly is connected to the strain wire 26 by means of a connector 40 provided at the inner end of the notches 39 (FIG. 2). The circuit through the striker pin assembly to cap 20 is completed by means of the strain wire 26.

STRIKER PIN ASSEMBLY

The striker pin assembly 16, as seen in FIGS. 1, 2, 6, 7, 8, and 9, includes a tubular housing 50 having a striker pin 52 mounted for movement within the tubular housing 50 from a first or withdrawn position to a second or indicating position. The pin 52 is biased outwardly from the housing 50 by means of a compression spring 54 which is seated on a shoulder 56 at the inner end of the housing 50 and bears against spring retainers 58 provided on the pin 52. The outward movement of the striker pin 52 is limited by means of a pair of stop pins 60 provided at the entrance to the tubular housing 50.

Means are provided within the tubular housing for holding the striker pin in the first position in the housing. Such means is in the form of an extension 62 provided at the inner end of the striker pin 52 and a flat surface 64 provided on the end of the housing 50. The extension 62 is provided with a plurality of openings 66. A number of openings 68 are provided in the surface 64 corresponding to the openings 66 provided in the extension 62. The pin 52 is retained within the housing 50 by means of a strain wire 70 which is threaded through the openings 66 and 68. This arrangement for holding the striker pin in the housing is shown in U.S. patent application Ser. No. 173,028 filed on July 28, 1980 by Edwin Link now U.S. Pat. No. 4,323,874 issed Apr. 6, 1982 and entitled "Blown Fuse Indicator." The strain wire 70 has one end connected to a tab 72 provided on the outside surface of the housing 50 and the other end connected to a contact spring 74 mounted on the inner end of the tube 50.

The striker pin assembly is an independent unit which is assembled in the fuse after the fuse has been completely assembled. The assembly is inserted through cap 20 into the recess provided by the notches 39 in the mica plates 28. The contact spring 74 will engage the conductor 40 located at the inner end of the notches 39 and the contact 72 will engage the termination plate 30 to provide electrical communication between the termination plate 30 and the conductor 40. The indicator circuit will be completed between the terminal caps 18 and 20 when the contacts 72 and 74 engage the plate 30 and conductor 40, respectively.

Figure 8:
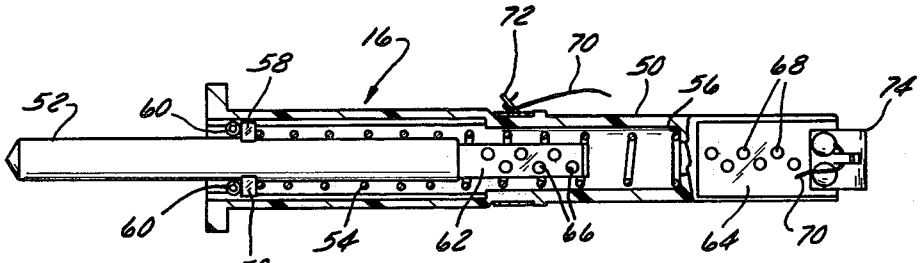
FIG. 8 is a view of the striker pin assembly in the extended position.

In the event of a fault current occurring which fuses the fuse elements 22, the fault current will pass through the strain wires 26 and 70. The wire 70 will vaporize releasing the pin extension 62 from the housing 50. The bias of spring 54 will move the striker pin 52 to a switch actuating or indicator position as seen in FIGS. 2 and 8.

I claim:

1. An energy-limiting fuse comprising a housing, an electrically conductive cap at each end of said housing, a spider assembly positioned within said housing, said spider assembly including a fuse element and electrically conductive means at each end of said spider assembly for terminating said fuse element, means electrically connecting each conductive means to the corresponding cap, said spider having a recess at one end and first electrical contact means mounted at the inner portion of the recess, a first strain wire mounted on said spider connecting said contact means to said conductive means at the end of said spider assembly remote from said recess, a striker pin assembly at least partially mounted in said recess and including a second electrical contact means for engaging said first contact means, a second strain wire for activating said striker pin assembly upon vaporization of said wire, said second strain wire connecting said second contact means to the conductive means at the other end of said spider assembly.

2. The fuse according to claim 1, wherein said striker pin assembly includes, a striker pin housing, a striker pin mounted within said housing, a spring biasing said striker pin outwardly from said housing, a strain wire passing through said housing and said striker pin to hold the striker pin position within said striker pin housing whereby said striker pin will be moved outwardly by said bias means on vaporization of said strain wire.

3. The fuse according to claim 1, wherein said fuse element is spirally wrapped about said spider assembly, and said spider assembly including means for constraining said element in a substantially parallel relation spaced a distance apart at least four times the width of said fuse element.

4. The fuse according to claim 1, wherein one of said caps includes an opening for mounting said striker pin assembly in said spider assembly after said caps are mounted on said housing.

5. The fuse according to claim 4, wherein said striker pin assembly includes a tubular housing having an electrical contact at one end, a striker pin within said housing, a spring biasing said pin outwardly from said housing, and a strain wire connected to said contact, said wire passing through the housing and the striker pin and being connected at the other end to said cap, whereby said striker pin will be free to move through said opening on vaporization of the strain wire.

6. An energy-limiting fuse comprising a tubular housing, a rigid spider assembly mounted within said housing, a plurality of notches in the outer edges of the spider, said notches being located in a spaced relation to define spiral parallel supporting surfaces, at least two fuse elements spirally wrapped around said spider, in a parallel spaced relation in said notches, said spider assembly including electrically conductive means at each end for terminating said fuse elements, said fuse elements are spaced apart a distance sufficient for each element to act independently, said spider also includes a recess at one end and a contact mounted at the inner end of the recess, a first strain wire mounted on said spider connecting the contact means to the conductive means at the opposite end of the spider assembly, a striker pin assembly partially mounted in the recess and having a contact at the inner end for engaging the contact at the inner end of the recess, a second strain wire for activating said striker pin assembly, said second strain wire connecting the pin contact to the conductive means at the other end of the spider assembly whereby said striker pin assembly will be activated on vaporization of the strain wire.

7. The fuse according to claim 6, wherein said notches are arranged to constrain the fuse elements in a spaced relation of at least four times the width of the elements.

8. The fuse according to claim 6, wherein said striker pin assembly includes a tubular housing, a striker pin mounted in said housing and means for biasing said pin outwardly from said housing.

* * * * *